US007039989B2

(12) United States Patent
Marty et al.

(10) Patent No.: US 7,039,989 B2
(45) Date of Patent: May 9, 2006

(54) MULTI-TRACK FASTENING SYSTEM

(75) Inventors: Justin Douglas Marty, Salt Lake City, UT (US); Joshua Craig Pace, Salt Lake City, UT (US)

(73) Assignee: Z Gear, Inc., Salt Lake City, UT (US)

( * ) Notice: Subject to any disclaimer, the term of this patent is extended or adjusted under 35 U.S.C. 154(b) by 0 days.

(21) Appl. No.: 10/638,990

(22) Filed: Aug. 11, 2003

(65) Prior Publication Data

US 2004/0055118 A1 Mar. 25, 2004

Related U.S. Application Data

(63) Continuation-in-part of application No. 10/251,177, filed on Sep. 20, 2002.

(51) Int. Cl.
*A44B 19/00* (2006.01)

(52) U.S. Cl. ..... 24/416; 24/382

(58) Field of Classification Search ..... 24/382, 24/429, 431, 416; 2/234; 5/413 R
See application file for complete search history.

(56) References Cited

U.S. PATENT DOCUMENTS

| | | | | |
|---|---|---|---|---|
| 361,250 | A | 4/1887 | Wright | |
| 2,136,879 | A | 11/1938 | Haber et al. | 2/270 |
| 2,178,885 | A * | 11/1939 | Buff et al. | 24/382 |
| 2,274,510 | A | 2/1942 | Wohl et al. | 2/270 |
| 2,483,057 | A * | 9/1949 | Levering | 24/382 |
| 2,622,248 | A | 12/1952 | Schaye | 2/80 |
| 2,744,253 | A | 5/1956 | Freedman | 2/80 |
| 2,856,609 | A | 10/1958 | Persico et al. | 2/269 |
| 2,889,605 | A | 6/1959 | Morin | 24/205 |
| 3,170,167 | A | 2/1965 | Isaacs | 2/269 |
| 3,214,771 | A | 11/1965 | Treiber | 2/270 |
| 3,219,084 | A * | 11/1965 | Ausnit et al. | 24/585.12 |
| 3,328,809 | A | 7/1967 | Payne et al. | 2/269 |
| 3,448,463 | A | 6/1969 | Milone | 2/234 |
| 3,726,329 | A | 4/1973 | Dean | 150/28 R |
| 3,771,169 | A | 11/1973 | Edmund | 2/2.1 R |
| 4,112,556 | A | 9/1978 | Flaum et al. | 24/205.1 R |
| 4,149,275 | A | 4/1979 | Sanchez | 2/269 |
| 4,158,892 | A | 6/1979 | Gonzales | 2/69.5 |
| 4,200,938 | A | 5/1980 | LeTourneau | 2/269 |
| 4,485,534 | A * | 12/1984 | Pilie et al. | 24/384 |
| 4,492,006 | A | 1/1985 | Ishii | 24/382 |
| 4,543,670 | A | 10/1985 | Ehring | 2/85 |
| 4,602,389 | A | 7/1986 | Brown | 2/243 R |
| 4,608,715 | A | 9/1986 | Miller et al. | 2/1 |
| 4,631,753 | A | 12/1986 | Ehring | 2/85 |
| 4,757,577 | A * | 7/1988 | Freeman | 24/382 |
| 4,896,379 | A | 1/1990 | Kape | 2/269 |
| 4,985,936 | A | 1/1991 | Jones | 2/269 |
| 5,031,944 | A | 7/1991 | Keyaki | 292/307 R |
| 5,033,127 | A | 7/1991 | Schmeltz | 2/269 |
| 5,044,015 | A | 9/1991 | Howard | 2/269 |
| 5,072,454 | A | 12/1991 | Trahan | 2/70 |
| 5,088,128 | A | 2/1992 | Kape | 2/269 |

(Continued)

*Primary Examiner*—Robert J. Sandy
(74) *Attorney, Agent, or Firm*—Julie H. Gheem; Kirton & McConkie

(57) ABSTRACT

A multi-track fastening system having multiple tracks and a central slider or interchange. The central slider has angled openings and paths through which the tracks travel when the central slider is propelled along the tracks. Sliding the central slider along the tracks causes the rows of the tracks to interchange so that a volume of material coupled to the tracks can alternate between two different configurations.

34 Claims, 6 Drawing Sheets

U.S. PATENT DOCUMENTS

| | | | | |
|---|---|---|---|---|
| 5,153,944 | A | 10/1992 | Teel | 2/243 R |
| 5,170,505 | A | 12/1992 | Rohrer | 2/69 |
| 5,208,920 | A | 5/1993 | Schaefer et al. | 2/269 |
| 5,299,323 | A | 4/1994 | Schaefer et al. | 2/93 |
| 5,490,294 | A | 2/1996 | Kramer | 5/413 |
| 5,535,453 | A | 7/1996 | Howard | 2/269 |
| 5,539,932 | A | 7/1996 | Howard | 2/269 |
| 5,575,010 | A | 11/1996 | Chung | 2/227 |
| 5,608,915 | A | 3/1997 | Libit | 2/228 |
| 5,697,130 | A | 12/1997 | Smith | 24/383 |
| 5,774,892 | A | 7/1998 | Tisdale et al. | 2/69 |
| 5,787,511 | A | 8/1998 | Garside | 2/269 |
| 5,794,265 | A | 8/1998 | Reich | 2/125 |
| 5,815,837 | A | 10/1998 | Christman et al. | 2/158 |
| 5,894,600 | A | 4/1999 | Chenefront | 2/69 |
| 5,953,758 | A | 9/1999 | Foster | 2/268 |
| 6,047,404 | A | 4/2000 | Blanks | 2/69 |
| 6,058,578 | A * | 5/2000 | Lan | 24/429 |
| 6,076,189 | A | 6/2000 | Christman et al. | 2/158 |
| 6,223,349 | B1 | 5/2001 | Roiser | 2/2.17 |
| 6,253,381 | B1 | 7/2001 | Kelley | 2/125 |
| 6,317,894 | B1 | 11/2001 | Blechman | 2/269 |
| 6,349,413 | B1 | 2/2002 | Rose et al. | 2/126 |
| 6,415,482 | B1 * | 7/2002 | Pontaoe | 24/429 |
| 6,742,225 | B1 | 6/2004 | Marty et al. | 24/382 |
| 2004/0128730 | A1 | 7/2004 | Marty et al. | 2/69 |
| 2004/0128731 | A1 | 7/2004 | Marty et al. | 2/69 |
| 2005/0034206 | A1 | 2/2005 | Marty et al. | 2/69 |

* cited by examiner

MULTI-TRACK FASTENING SYSTEM

RELATED APPLICATION

This application is a continuation-in-part of U.S. Utility patent application Ser. No. 10/251,177, filed Sep. 20, 2002, and titled CONNECT-RELEASE ZIPPING SYSTEM.

BACKGROUND

1. Field of the Invention

The present invention relates generally to methods and systems for transforming, via a fastening mechanism, a compartment of material or fabric into varied shapes or configurations. More particularly, the present invention relates to a multi-track fastening device that, with a single pushing or pulling motion, connects two sides of material while simultaneously disconnecting two other sides of material.

2. Background Information

Countless devices contain fasteners, one popular type of which is a zipper. A typical zipper includes a track or chain having two rows of teeth that interlock with each other. A zipper slider is located on the track so that a user can pull on a pull tab on the zipper slider in order to move the slider up and down the track, thereby causing the zipper to zip open and closed as desired. Some zippers have a stop at one or both ends of the zipper to stop the zipper slider from moving off of the track. Some zippers are designed so that the zipper slider is never removed from the track; other zippers are designed to allow the zipper slider to be removed from one row of the track, thereby allowing the material attached to one row of teeth to be further separated from the material attached to the other row of teeth.

Multi-zippered devices are among the many devices that incorporate zipper technology. For example, one existing multi-zippered device includes three adjacent rows of zipper teeth, the central row of which has two opposing zipper sliders at opposite ends of the row. The user may thus choose to attach one of the adjacent rows to one of the zipper sliders so that the central row and the adjacent row can be zipped up to form a first zipper track. Alternatively, the user may choose to attach the other adjacent row of teeth via the opposing zipper slider so that this adjacent row and the central row can be zipped up to form a second zipper track. This multi-zippered device is used to vary the size or volume of (for example) a laundry bag, but is cumbersome to use.

Another multi-zippered device has two parallel zippers that lie on top of each other. The user can choose to use either of the zippers to zip up an article of clothing in which this zipper device is incorporated. For example, this multi-zippered device, when incorporated into a pair of pants, allows a person to choose to zip up either the first zipper or the second zipper, thereby effectively creating two alternative waist sizes of pants within a single pair of pants. Thus, this particular multi-zippered device can be useful in accommodating weight gain or loss by the person who wears the clothing, but is awkward to incorporate into clothing and is also awkward to use.

Yet another multi-zippered device has an exchange portal through which the ends of a pair of zipper teeth are inserted and through which each row of teeth are thereby exchanged and mated with another pair of zipper teeth. This device has an elongated extension at the end of the row of zipper teeth in order to facilitate the entry of the end of the row into a small slot in the exchange portal. This multi-zippered device is designed to attach a chemical jumpsuit to a chemical laboratory tent without exposing the insides of the jumpsuit or tent to the outside environment. As with many other multi-zippered devices, this multi-zippered device inconveniences the user because it requires him or her to manually align and insert the end of a row of zipper teeth into a small slot.

As can be seen from the examples above, known multi-zippered devices either have limited functionality and/or are complicated and unwieldy to use, thus contributing to the limited commercial success of many multi-zippered devices.

SUMMARY AND OBJECTS OF THE INVENTION

The present invention basically comprises a multi-track fastening system having multiple tracks and a central slider or interchange. The central slider has angled openings and paths through which the tracks travel when the central slider is propelled along the tracks. Sliding the central slider along the tracks causes the rows of the tracks to interchange so that a volume of material coupled to the tracks can alternate between different shapes or configurations. In the preferred embodiments of the present invention, this alternation between configurations conveniently takes place without exposing any contents inside the volume of material to the environment exterior to the volume of material.

Accordingly, it is an object of some embodiments of the present invention to provide a simple-to-use device that compartmentalizes a volume of material into varying shapes or compartments.

Another object of some embodiments of the present invention is to provide a multi-zippered compartmentalizing device that accomplishes the interchange of rows of zipper teeth with a single push or pull on the device by a user.

Another object of some embodiments of the present invention is to provide a multi-zippered compartmentalizing system wherein a central zipper slider coupled to the zipper tracks has angled openings that allow the central slider to be propelled along the tracks when a user pulls at fabric coupled to the zipper tracks.

Yet another object of some embodiments of the present invention is to provide a simple multi-zippered system that transforms a closed volume of material or fabric into alternative configurations, both of which have the same quantum of volume, the transformation taking place without exposing any contents inside the volume of material to the exterior environment.

BRIEF DESCRIPTION OF THE DRAWINGS

The foregoing and other objects and features of the present invention will become more fully apparent from the accompanying drawings when considered in conjunction with the following description and appended claims. Other objects will likewise become apparent from the practice of the invention as set forth hereafter. Although the drawings depict only typical embodiments of the invention and are thus not to be deemed limiting of the invention's scope, the accompanying drawings help explain the invention in added detail.

DETAILED DESCRIPTION OF EMBODIMENTS OF THE PRESENT INVENTION

The following detailed description, in conjunction with the accompanying drawings (hereby expressly incorporated as part of this detailed description), sets forth specific numbers, materials, and configurations in order to provide a thorough understanding of the present invention. The following detailed description, in conjunction with the drawings, will enable one skilled in the relevant art to make and use the present invention.

One purpose of this detailed description being to describe the invention so as to enable one skilled in the art to make and use the present invention, the following description sets forth various specific examples, also referred to as "embodiments," of the present invention. While the invention is described in conjunction with specific embodiments, it will be understood, because the embodiments are set forth for explanatory purposes only, that this description is not intended to limit the invention to these particular embodiments. Indeed, it is emphasized that the present invention can be embodied or performed in a variety of ways. The drawings and detailed description are merely representative of particular embodiments of the present invention.

Reference will now be made in detail to several embodiments of the invention. The various embodiments will be described in conjunction with the accompanying drawings wherein like elements are generally designated by like alphanumeric characters throughout.

Figure 1:
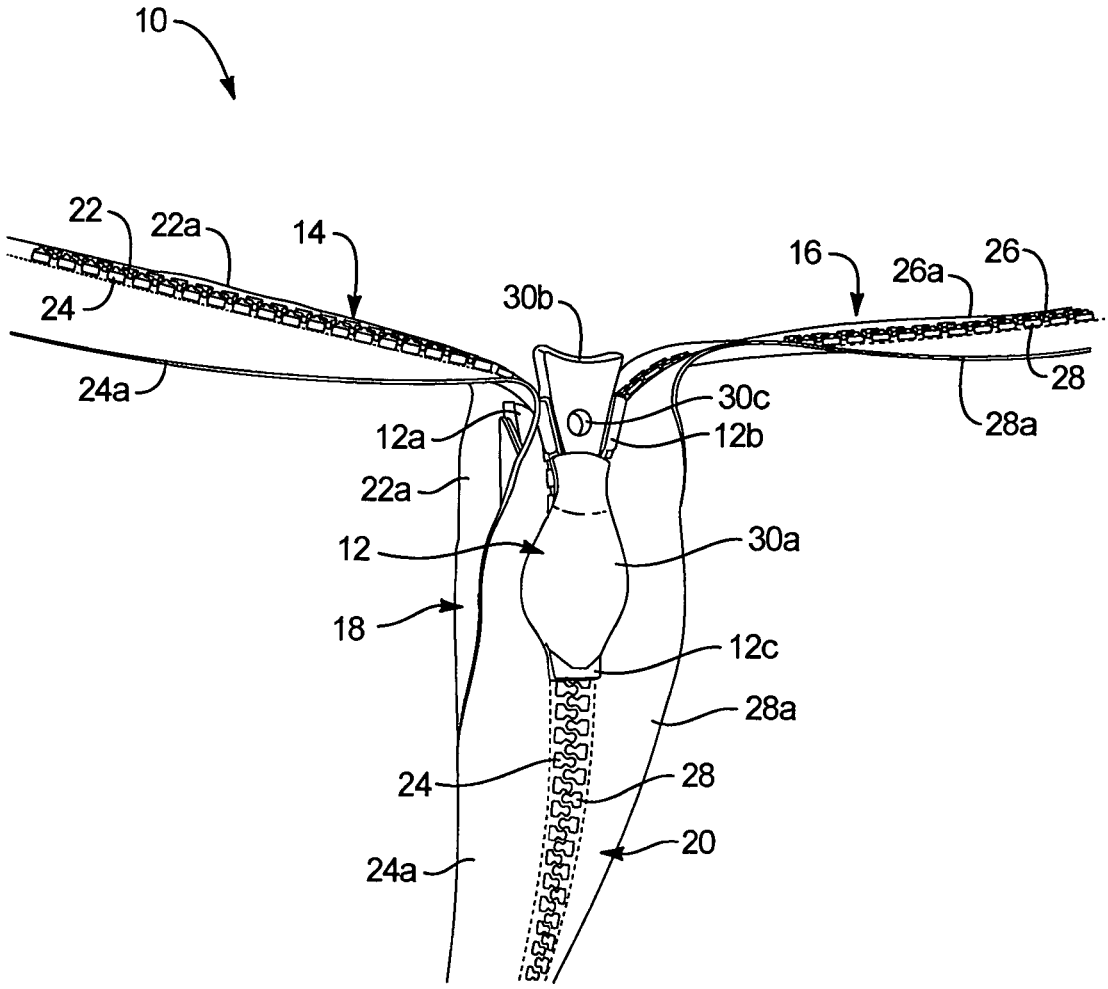
FIG. 1 is a perspective view showing one embodiment of the multi-track fastening system of the present invention.
Figure 2:
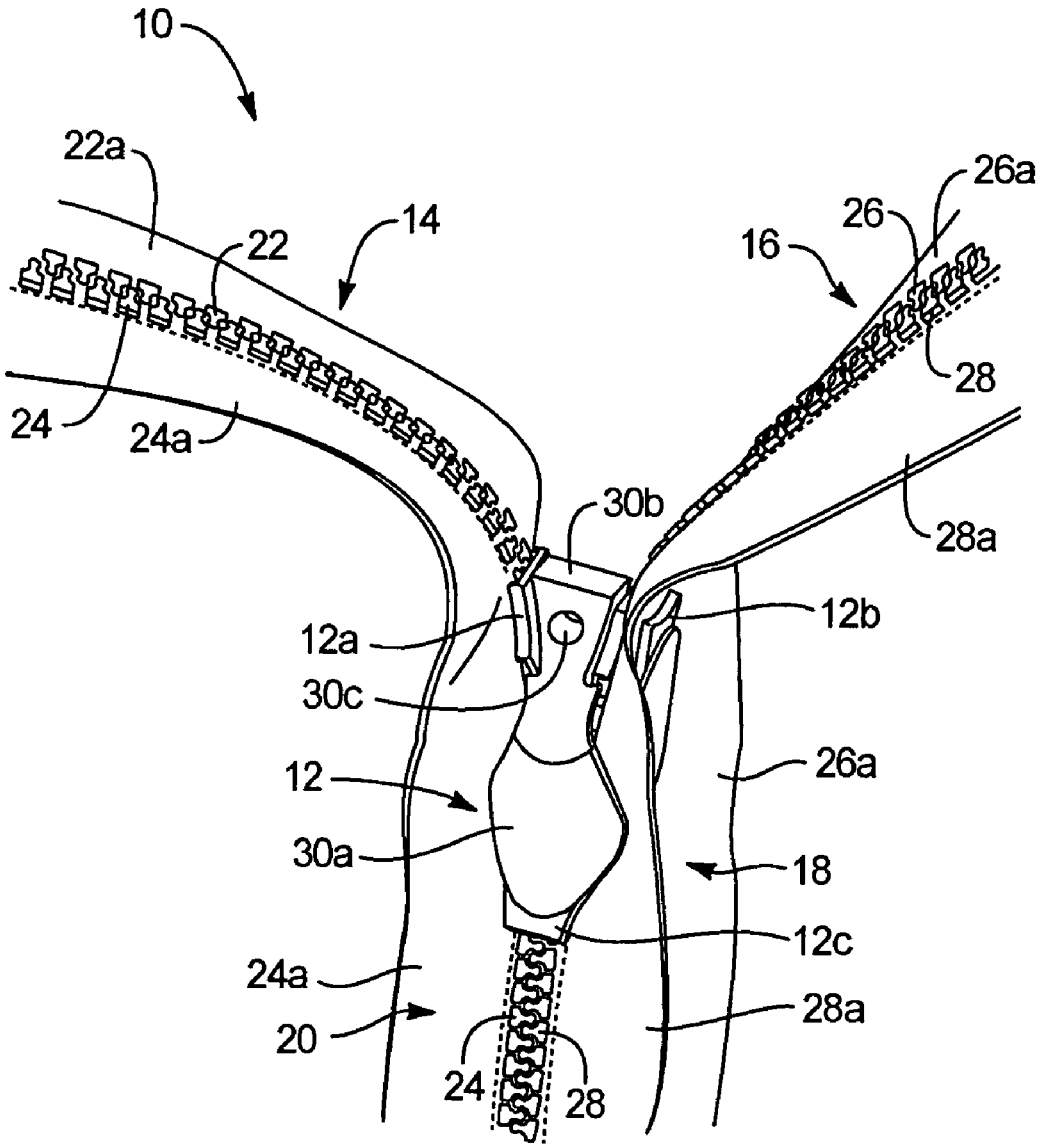
FIG. 2 is another perspective view of an embodiment of the multi-track fastening system of the present invention.

FIGS. 1 and 2 show perspective views of a multi-track fastening system 10 according to some embodiments of the present invention. Multi-track fastening system 10 basically comprises a first track 14, a second track 16, and a central slider or interchange 12. First track 14 comprises two fastener rows 22 and 24, here shown as zipper teeth, that are matable with each other. Second track 16 also comprises two matable fastener rows 26 and 28, here also shown as zipper teeth. The tracks 14 and 16 are coupled to material or fabric 44 (shown, for example, in FIGS. 7A and 7B) via strips of tape or other connector material (that is, anything serving to directly connect the fastener rows to material or fabric 44) 22*a*, 24*a*, 26*a*, and 28*a* extending from each side of the rows. Preferably, the fastener rows each comprise a row of teeth that interlock with another fastener row of teeth such as those shown in the Figures. The fastener rows can be made of any type of material, including metal, plastic, and nylon, and can have any variety of shapes, weights, and lengths. In addition, the multi-track fastening system 10 can have any number of fastener rows or tracks, and the fastener rows need not be physically completely separate from each other—that is, some fastener rows could comprise different parts of one continuous fastener strip.

Figure 3:
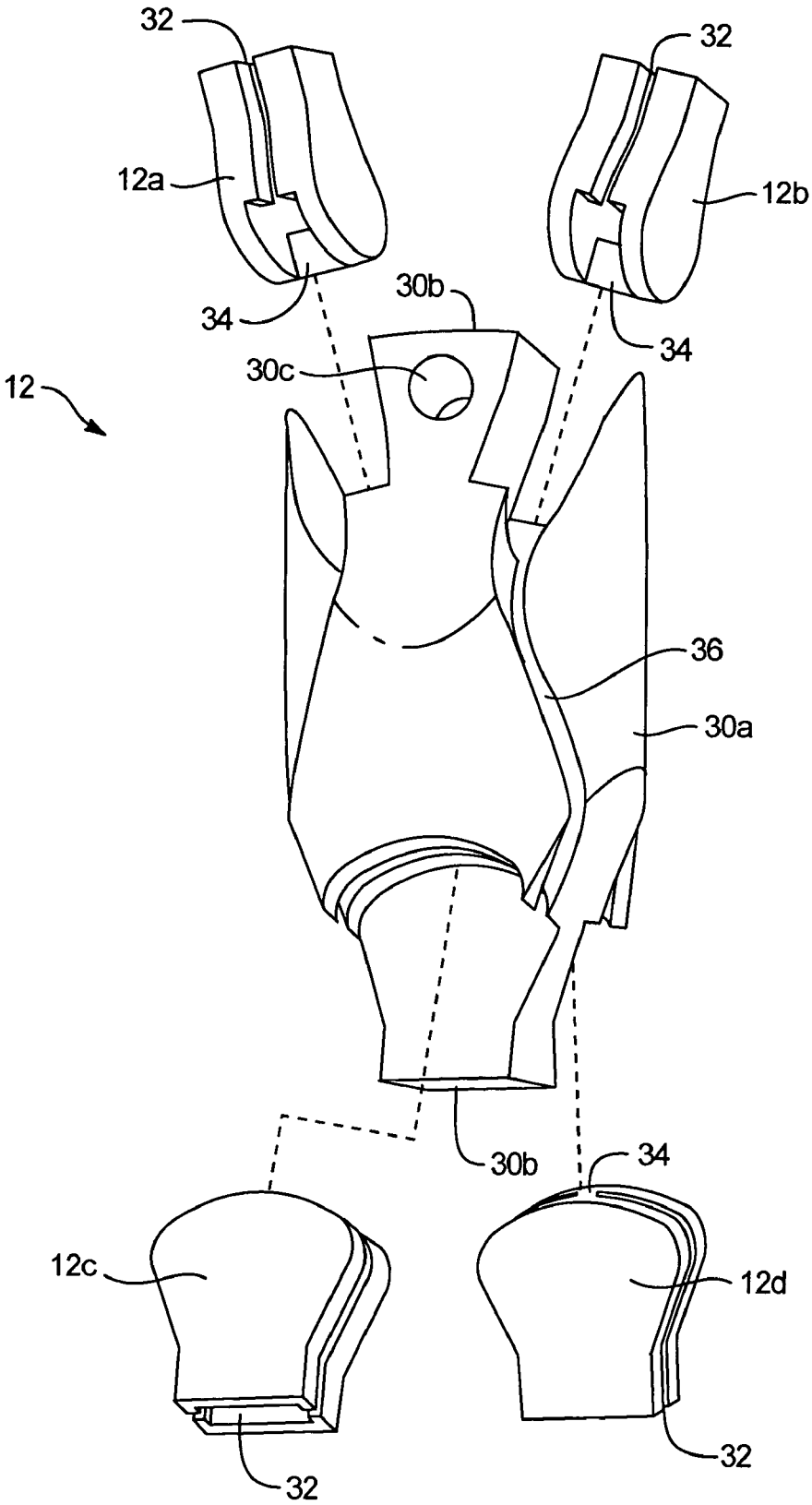
FIG. 3 is an exploded perspective view of one embodiment of the central slider in the multi-track fastening system of the present invention.

Central slider 12 comprises various parts, including slider parts 12*a* through 12*d* (an example of which can be seen best in FIG. 3). Central slider 12 closes or mates some of the fastener rows together when it is slid along the tracks. Central slider 12 can also open or disengage some of the fastener rows apart from each other when the central slider 12 is slid along the tracks.

Central slider 12 includes an outer surface 30*a* that is preferably tapered so as to allow a user to easily grasp the sides of the surface 30*a* and thereby either push or pull on the central slider 12 to propel the central slider 12 along the tracks. Outer surface 30*a* preferably includes one or more ends 30*b* upon which the user may push to propel the central slider 12 along the tracks. Note that in some embodiments, as in that shown in FIG. 1, end 30*b* extends from the central slider 12. In other embodiments, as in that shown in FIGS. 2 and 6, end 30*b* sits closer in with the rest of the central slider 12 (in FIG. 6, the embodiment of the end 30*b* located at the left end of the central slider 12 has a curved indentation to more easily accommodate the user's finger when the user pushes against the end 30*b* to propel the central slider 12). Note that a hole 30*c* can be optionally placed in central slider 12 so that a pull cord 40 (see FIGS. 7A and 7B) can be inserted into it to further facilitate the user's ability to propel the central slider 12 along the tracks. Whether the central slider 12 is propelled by pushing or pulling on surface 30*a* or by tugging on pull cord 40, the means for propelling the central slider 12 preferably involves symmetrically balanced pressure exerted by the user upon the central slider 12. In other words, the preferred construction of the propulsion means is such that the user's force thereon is symmetrically balanced in that the sum of the user's vector forces results in a vector force that aligns with the direction of desired movement of the central slider 12. Note that a pull tab located on only one side of the central slider 12 would cause the central slider 12 to lean in one direction when the pull tab is pulled; such a propulsion means is not symmetrically balanced.

When the central slider 12 is propelled along the tracks, the rows of the tracks interchange. For example, as can be seen in FIGS. 1 and 2, the rows 22, 24, 26, and 28 of the two tracks 14 and 16 interchange so as to re-form into tracks 18 and 20. At the top of FIGS. 1 and 2, it can be seen that track 14 comprises the mated rows 22 and 24, and track 16 comprises the mated row 26 and 28. In the preferred embodiments of the present invention, central slider 12 is irremovably coupled to the tracks in that the central slider 12 is not designed to be removed from any of the fastener rows, unlike some standard zippers found on jackets, for example (wherein a zipper slider is detachable from one row of zipper teeth at the bottom of the jacket in order to allow a person wearing the jacket to remove it or wear it open). However, some embodiments of the present invention contemplate a central slider 12 that can be removed from one or more of the fastener rows, some of which might include an end piece designed to be manually insertable into the central slider 12.

FIG. 3 is an exploded perspective view of a central slider 12. Slider parts 12*a* through 12*d* enable the tracks 14, 16, 18, and 20 to enter and exit the central slider 12 at openings 32 so that the rows are in a closed, zipped-up, or mated state. The slider parts 12*a* through 12*d* cause the mated fastener rows to disengage, preferably via a wedge 34 inside each of paths 36 (described further herein), in preparation for the interchange.

Figure 5:
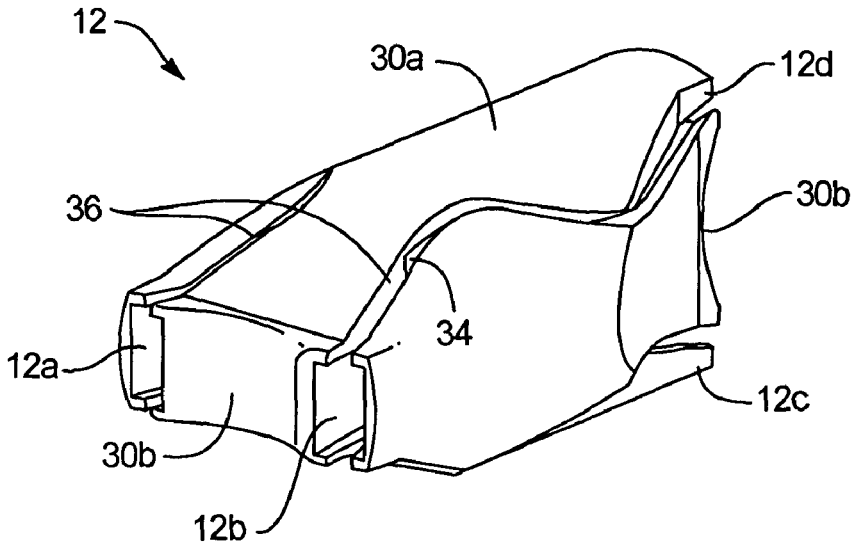
FIG. 5 is a perspective view of another embodiment of the central slider in the multi-track fastening system of the present invention.
Figure 6:
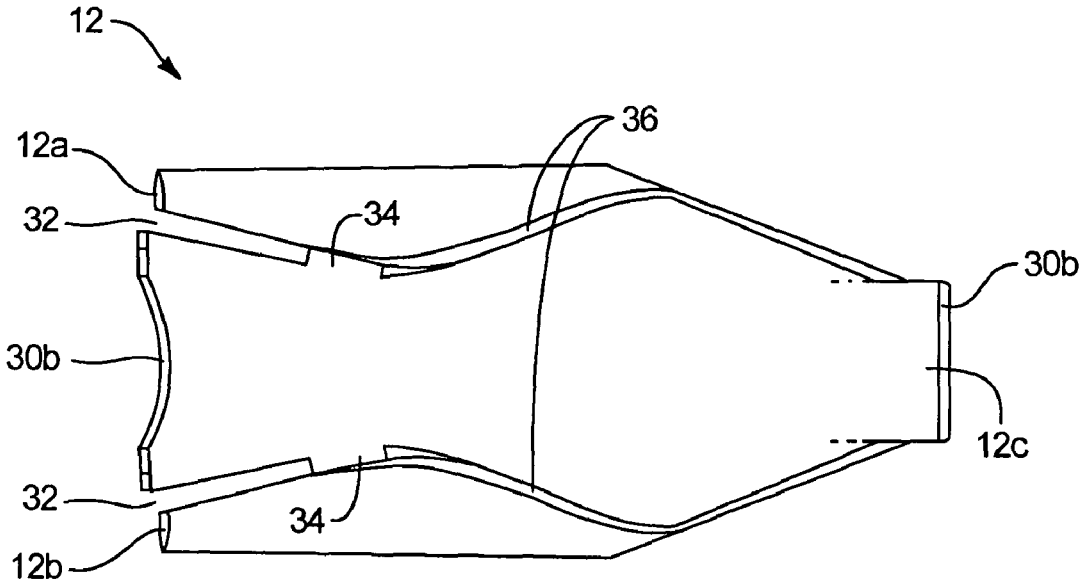
FIG. 6 is a side plan view of the embodiment shown in FIG. 5.

In some embodiments of the central slider 12, the slider parts 12*a* through 12*d* are placed into the remainder of the body of the central slider 12 during the assembly process. The slider parts 12*a* through 12*d* may be insert molded, injection molded, snapped in, sonic welded, or otherwise coupled to the central slider 12. Some embodiments of the central slider 12, such as those shown in FIGS. 5 and 6, are made of one integral piece formed, for example, by using a single mould.

Central slider 12 includes paths 36 in which the tracks travel, causing the rows of the tracks to interchange as previously described. Paths 36 begin at the slider parts 12*a* through 12*d*, each of which preferably have openings 32 that are angled (for example, the angle between vertical and the dotted line pointing to slider part 12*b* in FIG. 3) to facilitate the movement of the central slider 12 along the tracks (or, in other words, movement of the tracks through the central slider 12). Additional preferred features that aid in such movement include: paths 36 that have gradual curves, ideally comprising a flattened or elongated helical shape such as the paths 36 shown in FIGS. 3 through 6; paths 36 that run substantially through the outer portions of the central slider 12 (again like those shown in FIGS. 3 through 6), as opposed to through the central cross section of the central slider 12; and paths 36 that are designed so as to allow at least a portion of the tape 22*a*, 24*a*, 26*a*, and 28*a* to move within the paths 36. In the preferred embodiments, some or all of these preferred features that aid in moving the central slider 12 along the tracks, together allow the user to pull at material 44 coupled to the tapes 22*a*, 24*a*, 26*a*, and 28*a* of the tracks and thereby conveniently propel the central slider 12 along the tracks without having to touch the central slider 12 (this pulling and propelling motion will be described further in conjunction with FIGS. 7A and 7B). Also, in some embodiments of the present invention, these motion-aiding features serve to prevent or minimize the bunching of any material or fabric 44 coupled to the tracks.

It will be noted that in the preferred embodiments of the present invention, the angled nature of the openings 32 causes the fastener rows to begin to rotate before the fastener rows start to disconnect from each other (via the wedges 34) in preparation for interchange. However, some embodiments of the present invention also contemplate that the openings 32 need not be angled.

Central slider 12 can be made of any sort of strong material, including stainless steel and plastic. In the preferred embodiments, central slider 12 is made entirely of aluminum and is substantially hollow, such as the embodiment shown in FIG. 3. When the central slider 12 is substantially hollow, the slider 12 enjoys the added advantage of being more lightweight than it otherwise would be.

Figure 4A:
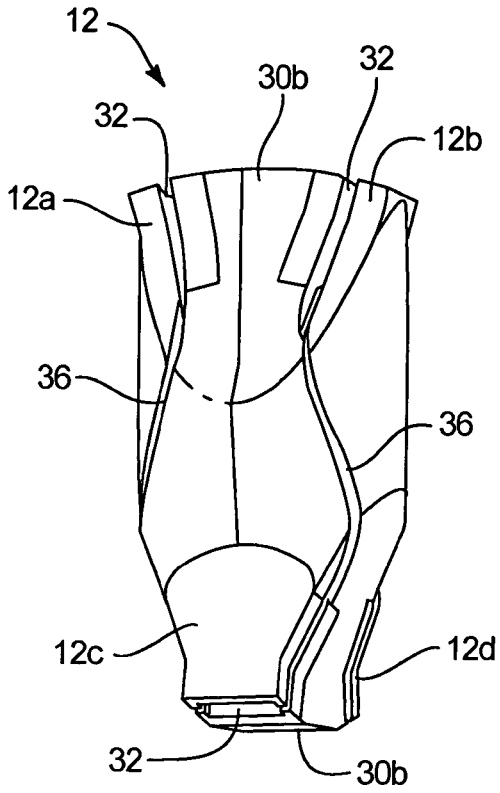
FIGS. 4A through 4C are perspective views of one embodiment of the central slider in the multi-track fastening system of the present invention.
Figure 4B:
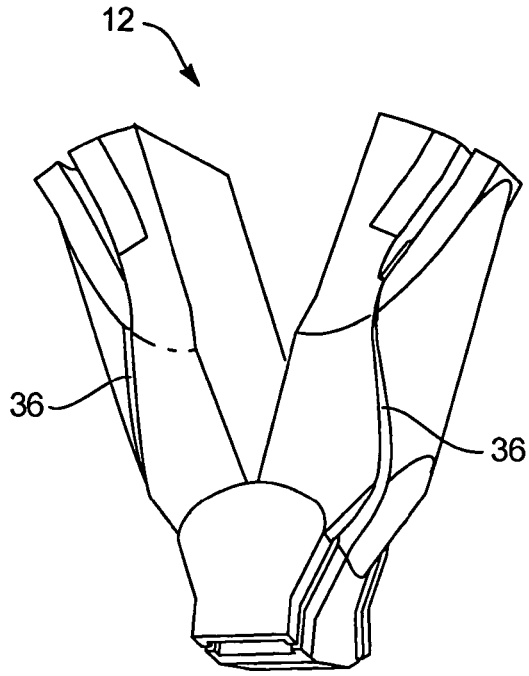
Figure 4C:
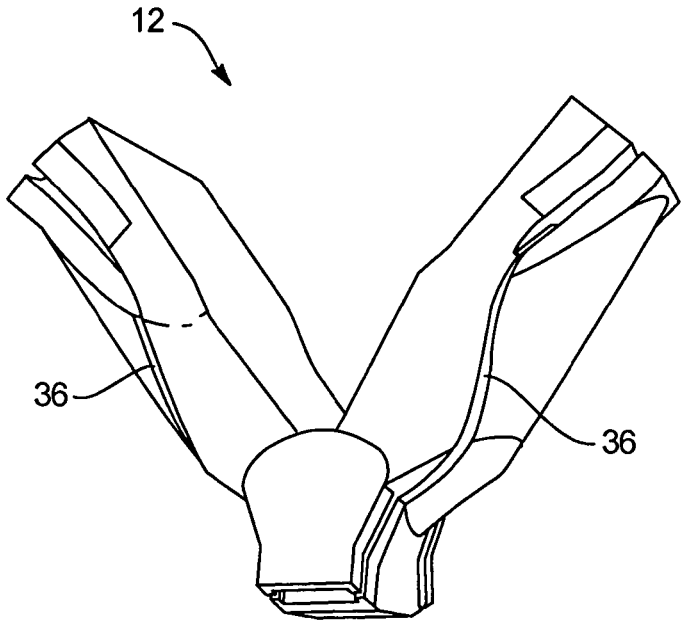

FIG. 4A shows one embodiment of the central slider 12 that has the capability of flaring outwardly, as shown in FIGS. 4B and 4C. This capability further facilitates the ability of the user to pull at material 44 coupled to the tapes 22*a*, 24*a*, 26*a*, and 28*a* of the tracks and thereby conveniently propel the central slider 12 along the tracks without having to touch the central slider 12 (again, this propelling feature will be described further in conjunction with FIGS. 7A and 7B). Note that the embodiment of the central slider 12 shown in FIGS. 4A through 4C show an example of a central slider 12 that is substantially solid.

Figure 7B:
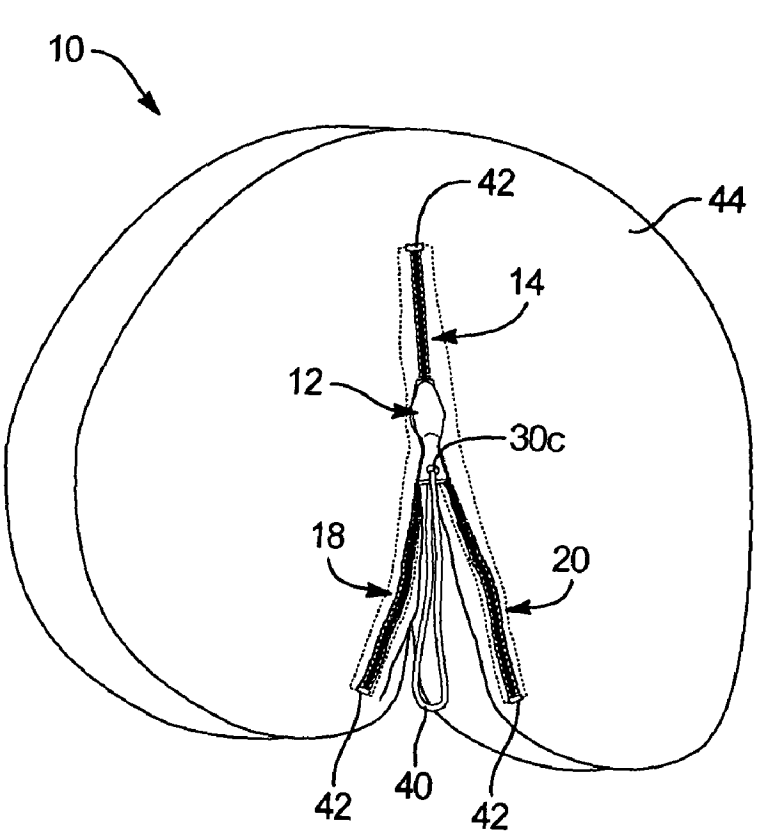
FIG. 7B shows the embodiment shown in FIG. 7A wherein the volume of material has been transformed into a different shape than that in FIG. 7A, the transformation being accomplished by the multi-track fastening system in accordance with one embodiment of the present invention.
Figure 7A:
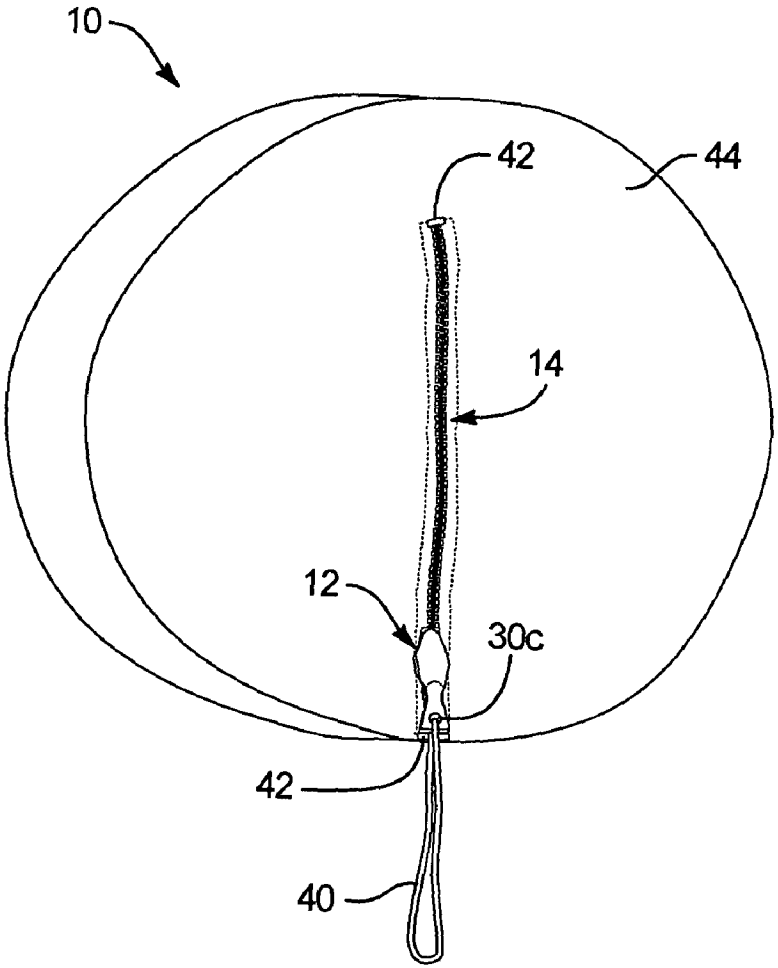
FIG. 7A is a perspective view of an embodiment of the multi-track fastening system as incorporated into a volume of material.

FIGS. 7A and 7B show an embodiment of the multi-track fastening system 10 as incorporated into a volume of material or fabric 44, preferably flexible or supple material such as that used in clothing or garments. FIG. 7A shows the material 44 formed into a closed, spherical volume. FIG. 7B shows how the spherical volume can change shape or be compartmentalized into different sections when the central slider 12 is moved along the tracks (note also that, although the configuration of the material 44 changes, the quantum of volume in FIG. 7B remains identical to that in FIG. 7A). Thus, with one simple push or pull on the central slider 12, a user can quickly and easily transform one volume of material 44 to an alternative shape without exposing any contents inside the volume to the exterior environment. This function could be advantageous in multiple circumstances.

In the preferred embodiments, as mentioned earlier, the user can also propel the central slider 12 by pulling the sections of material 44 located on each side of the tracks away from each other so as to propel the central slider 12 along the tracks. For example, with respect to the embodiment shown in FIG. 7A, the user might grab the left half of the material 44 with one hand and the right half of the material 44 with the other hand, and then pull the two halves away from each other so that the central slider 12 is propelled upwards as shown in FIG. 7B. Thus, the user can propel the central slider 12 along the tracks without even having to touch the central slider 12 or any extension thereon. Angled openings 32 in the central slider 12 preferably help facilitate this ability to propel the central slider 12 without touching it.

Note that, in some embodiments, end stops 42 can be placed at the ends of the tracks to prevent the central slider 12 from moving off the tracks. In addition, the present invention contemplates that any number of tracks may be incorporated into the volume of material 44 and that, in some embodiments, the volume of material 44 need not be closed or have a fixed quantum. For example, in embodiments wherein the central slider 12 is designed to be removable from some of the fastener rows, a first closed volume might be attachable to a second closed volume via the central slider 12 to create a third closed volume equal to the sum of the first and second closed volumes.

It should be emphasized that the present invention is not limited to the examples described in this Detailed Description. For example, as mentioned earlier, the central slider 12 may be coupled to multiple tracks of a number greater than two. Also, the tracks, central slider, slider parts, volume of material, and any two or more of various other parts of the present invention all may be manufactured so as to comprise integrally created pieces instead of physically separate pieces. The parts of the present invention may be made of any material and be made into any shape that will accomplish the functions of the present invention.

It is underscored that the present invention may be embodied in other specific forms without departing from its spirit or essential characteristics. The described embodiments herein should be deemed only as illustrative. Indeed, the appended claims indicate the scope of the invention; the description, being used for illustrative purposes, does not limit the scope of the invention. All variations that come within the meaning and range of equivalency of the claims are to be embraced within their scope.

What is claimed is:

1. A system comprising:

a first track and a second track, each track comprising two fastener rows matable with each other;

a central slider coupled to and slideable along both the first and second tracks, said central slider having a first end and a second end;

a plurality of paths in said central slider, said paths through which said tracks travel when said slider slides along said tracks, the paths thereby causing the rows of the first and second tracks to interchange; and an angled opening at each end of the central slider, said openings being shaped to facilitate rotation of the tracks within the central slider so that the rotation of the tracks within said central slider begins while the fastener rows are being disconnected from each other in preparation for said interchange.

2. The system of claim 1 wherein a strip of tape is coupled to each track and a portion of the tape travels within said plurality of paths when the track corresponding to the strip of tape travels within said plurality of paths.

3. The system of claim 1 wherein said central slider is irremovably coupled to said tracks.

4. The system of claim 1 further comprising a closed volume of supple material coupled to the tracks, the closed volume of supple material having first and second alternative shapes each having an identical quantum of volume.

5. The system of claim 1 wherein said central slider has an outer surface having a tapered shape to allow a user to both push and pull the central slider along the tracks in a symmetrically balanced force of direction.

6. The system of claim 1 further comprising supple fabric coupled to the tracks, and wherein the paths are shaped like flattened helixes so that the combination of the shape of the openings of the central slider as well as the shape of the paths allows the user to propel the central slider along the tracks without touching the central slider by pulling at the fabric coupled to the tracks.

7. The system of claim 1 wherein said central slider has a pull cord.

8. The system of claim 1 wherein said central slider is substantially hollow.

9. The system of claim 1 wherein said central slider is integrally formed from a single mould.

10. The system of claim 1 wherein said central slider is formed by coupling multiple pieces via insert molding.

11. A system comprising:

a first track and a second track, each track comprising two rows of fastener rows matable with each other;

a central slider irremovably coupled to and slideable along both the first and second tracks, said central slider having a first end and a second end;

an angled opening at each end of the central slider, said angled openings being shaped to facilitate rotation of the tracks within the central slider; and a plurality of paths in said central slider, said paths through which said tracks travel when said slider slides along said tracks, the paths thereby causing the rows of the first and second tracks to rotate and interchange, said paths being shaped like flattened helixes to allow the tracks to smoothly rotate within said central slider with minimal bunching of any fabric coupled to said tracks.

12. The system of claim 11 wherein said central slider is shaped so that the rotation of the tracks within said central slider begins while the fastener rows are being disconnected from each other in preparation for said interchange.

13. The system of claim 11 wherein a tape is coupled to each track and a portion of the tape travels within said plurality of paths when the track corresponding to the tape travels within said plurality of paths.

14. The system of claim 1 wherein said tracks are incorporated into material so that the material can be compartmentalized into alternative volumes without changing the quantum of volume.

15. The system of claim 1 wherein said central slider has an outer surface having a tapered shape to allow a user to easily push the central slider at either end of the central slider in one direction along the tracks as well as pull the slider in the opposite direction along the tracks by contacting the central slider with only one of the user's hands.

16. The system of claim 1 further comprising supple fabric coupled to the tracks, and wherein the combination of the angled openings of the central slider as well as the shape of the paths allows the user to propel the central slider along the tracks without touching the central slider by pulling at the fabric coupled to the tracks.

17. The system of claim 1 wherein said central slider is substantially hollow.

18. The system of claim 1 wherein said central slider is formed by coupling multiple slider parts via injection molding.

19. A system comprising:

a plurality of tracks, each track comprising two fastener rows matable with each other;

a closed volume of supple material coupled to the tracks;

a central interchange coupled to the plurality of tracks;

a plurality of angled openings in the central interchange, said angled openings being shaped to facilitate movement of the tracks within the central interchange; and a plurality of paths in said central interchange, said paths through which said tracks travel, thereby causing the rows of the tracks to interchange and the closed volume of supple material to change shape while still maintaining the same quantum of volume.

20. The system of claim 19 wherein said paths in the central interchange are curved at an angle that causes the tracks within said central slider to begin to rotate while simultaneously causing the fastener rows to begin to disconnect from each other in preparation for interchange.

21. The system of claim 19 wherein a tape is coupled to each track and a portion of the tape travels within said plurality of paths when the track corresponding to the tape travels within said plurality of paths.

22. The system of claim 19 wherein the combination of the angled openings of the central interchange as well as the shape of the outer surface of the central interchange allows the user to propel the central interchange along the tracks without touching the central interchange by pulling at the supple material coupled to the tracks.

23. A system comprising:

a first track and a second track, each track comprising two matable fastener rows; and a means for interchanging said rows with each other that causes the rows to rotate and disconnect before interchanging, wherein the rotation and disconnection take place substantially simultaneously, said means having a central longitudinal axis and exit and entry openings for the tracks that allow the tracks to enter and exit said means at an angle nonparallel with the central longitudinal axis.

24. The system of claim 23 wherein said means is irremovably coupled to said tracks.

25. The system of claim 23 wherein said means is removably coupled to said tracks.

26. The system of claim 23 further comprising a closed volume of supple material coupled to the tracks, the closed volume of supple material having first and second alternative shapes each having an identical quantum of volume.

27. The system of claim 23 wherein the means for interchanging rows comprises a plurality of curved paths located substantially around the outer cross section of a central slider.

28. The system of claim 23 wherein the means for interchanging rows comprises a plurality of slider parts, the slider parts having openings whose orientations lack angles that facilitate entry of the tracks into the openings.

29. The system of claim 23 wherein the means for interchanging rows can attach a first closed volume to a second closed volume to create a third closed volume.

30. The system of claim 23 wherein the means for interchanging rows comprises a central slider that can flare outwardly to facilitate movement of the slider along the tracks.

31. A system comprising:

a first zipper track and a second zipper track, each zipper track comprising two rows of zipper teeth;

a central zipper slider coupled to and slideable along both the first and second zipper tracks, said central slider having a first end and a second end and a central longitudinal axis;

angled exit and entry openings in the central slider for entry and exit of said tracks, said openings being angled so that the tracks exit and enter the central slider at an angle nonparallel with the central longitudinal axis of the central slider;

a plurality of paths in said central zipper slider, said paths through which said zipper tracks travel when said slider slides along said tracks, the paths thereby causing the rows of the first and second zipper tracks to interchange; and a means for propelling the central zipper slider along said tracks.

32. A system comprising:

a plurality of tracks, each track comprising two fastener rows matable with each other;

a closed volume of supple material coupled to the tracks;

a central interchange coupled to the plurality of tracks, said interchange comprising one indivisible piece;

a plurality of openings in the central interchange, said openings being shaped to facilitate movement of the tracks within the central interchange; and a plurality of paths in said central interchange, said paths through which said tracks travel, thereby causing the rows of the tracks to interchange and the closed volume of supple material to change shape while still maintaining the same quantum of volume.

33. A method of changing configuration of a closed volume of supple material, comprising:

providing a closed volume of supple material coupled to a plurality of zipper tracks; and placing force on a central slider, said central slider having a plurality of openings through which said zipper tracks enter and exit, said force causing said central slider to move along said zipper tracks and simultaneously interchange them, said interchange causing said closed volume of material to alternate configurations between a divided closed volume and an undivided volume.

34. The method of claim 33 wherein the placing of force on the central slider is accomplished by pulling at the portions of the material coupled to the tracks without the need to directly touch the central slider.

* * * * *